US007762353B2

(12) United States Patent
Hall et al.

(10) Patent No.: US 7,762,353 B2
(45) Date of Patent: Jul. 27, 2010

(54) DOWNHOLE VALVE MECHANISM

(75) Inventors: David R. Hall, Provo, UT (US); John Bailey, Spanish Fork, UT (US)

(73) Assignee: Schlumberger Technology Corporation, Houston, TX (US)

( * ) Notice: Subject to any disclaimer, the term of this patent is extended or adjusted under 35 U.S.C. 154(b) by 211 days.

(21) Appl. No.: 12/039,608

(22) Filed: Feb. 28, 2008

(65) Prior Publication Data

US 2008/0142263 A1 Jun. 19, 2008

Related U.S. Application Data

(63) Continuation-in-part of application No. 12/037,682, filed on Feb. 26, 2008, now Pat. No. 7,624,824, which is a continuation-in-part of application No. 12/019,782, filed on Jan. 25, 2008, now Pat. No. 7,617,886, which is a continuation-in-part of application No. 11/837,321, filed on Aug. 10, 2007, now Pat. No. 7,559,379, which is a continuation-in-part of application No. 11/750,700, filed on May 18, 2007, now Pat. No. 7,549,489, which is a continuation-in-part of application No. 11/737,034, filed on Apr. 18, 2007, now Pat. No. 7,503,405, which is a continuation-in-part of application No. 11/686,638, filed on Mar. 15, 2007, now Pat. No. 7,424,922, which is a continuation-in-part of application No. 11/680,997, filed on Mar. 1, 2007, now Pat. No. 7,419,016, which is a continuation-in-part of application No. 11/673,872, filed on Feb. 12, 2007, now Pat. No. 7,484,576, which is a continuation-in-part of application No. 11/611,310, filed on Dec. 15, 2006, now Pat. No. 7,600,586, application No. 12/039,608, which is a continuation-in-part of application No. 11/278,935, filed on Apr. 6, 2006, now Pat. No. 7,426,968, which is a continuation-in-part of application No. 11/277,394, filed on Mar. 24, 2006, now Pat. No. 7,398,837, which is a continuation-in-part of application No. 11/277,380, filed on Mar. 24, 2006, now Pat. No. 7,337,858, which is a continuation-in-part of application No. 11/306,976, filed on Jan. 18, 2006, now Pat. No. 7,360,610, which is a continuation-in-part of application No. 11/306,307, filed on Dec. 22, 2005, now Pat. No. 7,225,886, which is a continuation-in-part of application No. 11/306,022, filed on Dec. 14, 2005, now Pat. No. 7,198,119, which is a continuation-in-part of application No. 11/164,391, filed on Nov. 21, 2005, now Pat. No. 7,270,196, application No. 12/039,608, which is a continuation-in-part of application No. 11/555,334, filed on Nov. 1, 2006, now Pat. No. 7,419,018.

(51) Int. Cl.
*E21B 7/00* (2006.01)

(52) U.S. Cl. ..... 175/38; 175/318; 175/324

(58) Field of Classification Search ..... 175/38, 175/317, 324
See application file for complete search history.

(56) References Cited

U.S. PATENT DOCUMENTS 616,118 A 12/1889 Kunhe (Continued)

*Primary Examiner*—Hoang Dang
(74) *Attorney, Agent, or Firm*—Holme Roberts & Owen LLC

(57) ABSTRACT

In one aspect of the invention, a downhole tool string component comprises a fluid passageway formed between a first and second end. A valve mechanism is disposed within the fluid passageway adapted to substantially cyclically build-up and release pressure within the fluid passageway such that a pressure build-up results in radial expansion of at least a portion of the fluid passageway and wherein a pressure release results in a contraction of the portion of the fluid passageway. The valve mechanism disposed within the fluid passageway comprises a spring. Expansion and contraction of the portion of the fluid passageway varies a weight loaded to a drill bit disposed at a drilling end of the drill string.

20 Claims, 7 Drawing Sheets

U.S. PATENT DOCUMENTS 465,103 A 12/1891 Wagner
946,060 A 1/1910 Looker
1,116,154 A 11/1914 Stowers
1,183,630 A 5/1916 Bryson
1,189,560 A 7/1916 Gondos
1,360,908 A 11/1920 Everson
1,387,733 A 8/1921 Midget
1,460,671 A 7/1923 Hebsacker
1,544,757 A 7/1925 Hufford
1,821,474 A 9/1931 Mercer
1,879,177 A 9/1932 Gault
2,054,255 A 9/1936 Howard
2,064,255 A 12/1936 Garfield
2,169,223 A 8/1939 Christian
2,218,130 A 10/1940 Court
2,320,136 A 5/1943 Kammarer
2,466,991 A 4/1949 Kammerer
2,540,464 A 2/1951 Stokes
2,544,036 A 3/1951 Kammerer
2,746,721 A * 5/1956 Moore ..... 175/317
2,755,071 A 7/1956 Kammerer
2,776,819 A 1/1957 Brown
2,819,043 A 1/1958 Henderson
2,838,284 A 6/1958 Austin
2,894,722 A 7/1959 Buttolph
2,901,223 A 8/1959 Scott
2,963,102 A 12/1960 Smith
3,135,341 A 6/1964 Ritter
3,294,186 A 12/1966 Buell
3,301,339 A 1/1967 Pennebaker, Jr.
3,379,264 A 4/1968 Cox
3,429,390 A 2/1969 Bennett
3,493,165 A 2/1970 Schonfield
3,583,504 A 6/1971 Aahund
3,764,493 A 10/1973 Rosar
3,821,993 A 7/1974 Kniff
3,955,635 A 5/1976 Skidmore
3,960,223 A 6/1976 Kleine
4,081,042 A 3/1978 Johnson
4,096,917 A 6/1978 Harris
4,106,577 A 8/1978 Summer
4,176,723 A 12/1979 Arceneaux
4,253,533 A 3/1981 Baker
4,280,573 A 7/1981 Sudnishnikov
4,304,312 A 12/1981 Larsson
4,307,786 A 12/1981 Evans
4,397,361 A 8/1983 Langford
4,416,339 A 11/1983 Baker
4,445,580 A 5/1984 Sahley
4,448,269 A 5/1984 Ishikawa
4,499,795 A 2/1985 Radtke
4,531,592 A 7/1985 Hayatdavoudi
4,535,853 A 8/1985 Ippolito
4,538,691 A 9/1985 Dennis
4,566,545 A 1/1986 Story
4,574,895 A 3/1986 Dolezal
4,615,399 A * 10/1986 Schoeffler ..... 175/38
4,640,374 A 2/1987 Dennis
4,817,739 A * 4/1989 Jeter ..... 175/38
4,852,672 A 8/1989 Behrens
4,889,017 A 12/1989 Fuller
4,962,822 A 10/1990 Pascale
4,979,577 A * 12/1990 Walter ..... 175/56
4,981,184 A 1/1991 Knowlton
5,009,273 A 4/1991 Grabinski
5,027,914 A 7/1991 Wilson
5,038,873 A 8/1991 Jurgens
5,119,892 A 6/1992 Clegg
5,141,063 A 8/1992 Quesenbury
5,186,268 A 2/1993 Clegg
5,222,566 A 6/1993 Taylor
5,255,749 A 10/1993 Bumpurs
5,265,682 A 11/1993 Russell
5,361,859 A 11/1994 Tibbitts
5,410,303 A 4/1995 Comeau
5,417,292 A 5/1995 Polakoff
5,423,389 A 6/1995 Warren
5,443,128 A * 8/1995 Amaudric du Chaffaut ... 175/25
5,507,357 A 4/1996 Hult
5,560,440 A 10/1996 Tibbitts
5,568,838 A 10/1996 Struthers
5,655,614 A 8/1997 Azar
5,678,644 A 10/1997 Fielder
5,732,784 A 3/1998 Nelson
5,794,728 A 8/1998 Palmberg
5,896,938 A 4/1999 Moeny
5,947,215 A 9/1999 Lundell
5,950,743 A 9/1999 Cox
5,957,223 A 9/1999 Doster
5,957,225 A 9/1999 Sinor
5,967,247 A 10/1999 Pessier
5,979,571 A 11/1999 Scott
5,992,547 A 11/1999 Caraway
5,992,548 A 11/1999 Silva
6,021,859 A 2/2000 Tibbitts
6,039,131 A 3/2000 Beaton
6,131,675 A 10/2000 Anderson
6,150,822 A 11/2000 Hong
6,186,251 B1 2/2001 Butcher
6,202,761 B1 3/2001 Forney
6,213,226 B1 4/2001 Eppink
6,223,824 B1 5/2001 Moyes
6,269,893 B1 8/2001 Beaton
6,296,069 B1 10/2001 Lamine et al.
6,340,064 B2 1/2002 Fielder
6,364,034 B1 4/2002 Schoeffler
6,394,200 B1 5/2002 Watson
6,439,326 B1 8/2002 Huang
6,474,425 B1 11/2002 Truax
6,484,825 B2 11/2002 Watson
6,510,906 B1 1/2003 Richert
6,513,606 B1 2/2003 Krueger
6,533,050 B2 3/2003 Molloy
6,594,881 B2 7/2003 Tibbitts
6,601,454 B1 8/2003 Botnan
6,622,803 B2 9/2003 Harvey
6,668,949 B1 12/2003 Rives
6,729,420 B2 5/2004 Mensa-Wilmot
6,732,817 B2 5/2004 Dewey
6,822,579 B2 11/2004 Goswani
9,629,076 4/2005 Fanuel
6,953,096 B2 10/2005 Glenhill
2003/0213621 A1 11/2003 Britten
2004/0238221 A1 12/2004 Runia
2004/0256155 A1 12/2004 Kriesels

* cited by examiner

DOWNHOLE VALVE MECHANISM

CROSS REFERENCE TO RELATED APPLICATIONS

This Patent application is a continuation-in-part of U.S. patent application Ser. No. 12/037,682 that issued as U.S. Pat. No. 7,624,824 to Hall et al., on Dec. 1, 2009; which is a continuation-in-part of U.S. patent application Ser. No. 12/019,782 that issued as U.S. Pat. No. 7,617,886 to Hall et al., on Nov. 17, 2009; which is a continuation-in-part of U.S. patent application Ser. No. 11/837,321 that issued as U.S. Pat. No. 7,559,379 to Hall et al., on Jul. 14, 2009; which is a continuation-in-part of U.S. patent application Ser. No. 11/750,700 that issued as U.S. Pat. No. 7,549,489 to Hall et al., on Jun. 23, 2009. U.S. patent application Ser. No. 11/750,700 is a continuation-in-part of U.S. patent application Ser. No. 11/737,034 that issued as U.S. Pat. No. 7,503,405 to Hall et al., on May 17, 2009. U.S. patent application Ser. No. 11/737,034 is a continuation-in-part of U.S. patent application Ser. No. 11/686,638 that issued as U.S. Pat. No. 7,424,922 to Hall et al., on Sep. 16, 2008. U.S. patent application Ser. No. 11/686,638 is a continuation-in-part of U.S. patent application Ser. No. 11/680,997 that issued as U.S. Pat. No. 7,419,016 to Hall et al., on Sep. 2, 2008. U.S. patent application Ser. No. 11/680,997 is a continuation-in-part of U.S. patent application Ser. No. 11/673,872 that issued as U.S. Pat. No. 7,484,576 to Hall et al., on Feb. 3, 2009. U.S. patent application Ser. No. 11/673,872 is a continuation-in-part of U.S. patent application Ser. No. 11/611,310 that issued as U.S. Pat. No. 7,600,586 to Hall et al., on Oct. 13, 2009. This Patent Application is also a continuation-in-part of U.S. patent application Ser. No. 11/278,935 that issued as U.S. Pat. No. 7,426,968 to Hall et al., on Sep. 23, 2008. U.S. patent application Ser. No. 11/278,935 is a continuation-in-part of U.S. patent application Ser. No. 11/277,394 that issued as U.S. Pat. No. 7,398,837 to Hall et al., on Jul. 15, 2008. U.S. patent application Ser. No. 11/277,394 is a continuation-in-part of U.S. patent application Ser. No. 11/277,380 that issued as U.S. Pat. No. 7,337,858 to Hall et al., on Mar. 4, 2008. U.S. patent application Ser. No. 11/277,380 is a continuation-in-part of U.S. patent application Ser. No. 11/306,976 that issued as U.S. Pat. No. 7,360,610 to Hall et al., on Apr. 22, 2008. U.S. patent application Ser. No. 11/306,976 is a continuation-in-part of Ser. No. 11/306,307 that issued as U.S. Pat. No. 7,225,886 to Hall on Jun. 5, 2007. U.S. patent application Ser. No. 11/306,307 is a continuation-in-part of U.S. patent application Ser. No. 11/306,022 that issued as U.S. Pat. No. 7,198,119 to Hall et al., on Apr. 3, 2007: U.S. patent application Ser. No. 11/306,022 is a continuation-in-part of U.S. patent application Ser. No. 11/164,391 that issued as U.S. Pat. No. 7,270,196 to Hall on Sep. 18, 2007. This application is also a continuation-in-part of U.S. patent application Ser. No. 11/555,334 filed on Nov. 1, 2006 and that issued as U.S. Pat. No. 7,419,018 to Hall et al., on Sep. 2, 2008. All of these applications are herein incorporated by reference in their entirety.

BACKGROUND OF THE INVENTION

This invention relates to the field of downhole drill strings. Increasing the rate of penetration in drilling saves substantial amount of time and money in the oil and gas, geothermal, exploration, and horizontal drilling industries.

U.S. Pat. No. 6,588,518 to Eddison, which is herein incorporated by reference for all that it contains, discloses a downhole drilling method comprising the production of pressure pulses in drilling fluid using measurement-while-drilling (MWD) apparatus and allowing the pressure pulses to act upon a pressure responsive device to create an impulse force on a portion of the drill string.

U.S. Pat. No. 4,890,682 to Worrall, et al., which is herein incorporated by reference for all that it contains, discloses a jarring apparatus provided for vibrating a pipe string in a borehole. The apparatus thereto generates at a downhole location longitudinal vibrations in the pipe string in response to flow of fluid through the interior of said string.

U.S. Pat. No. 4,979,577 to Walter et al., which is herein incorporated by reference for all that it contains, discloses a flow pulsing apparatus adapted to be connected in a drill string above a drill bit. The apparatus includes a housing providing a passage for a flow of drilling fluid toward the bit. A valve which oscillates in the axial direction of the drill string periodically restricts the flow through the passage to create pulsations in the flow and a cyclical water hammer effect thereby to vibrate the housing and the drill bit during use. Drill bit induced longitudinal vibrations in the drill string can be used to generate the oscillation of the valve along the axis of the drill string to effect the periodic restriction of the flow or, in another form of the invention, a special valve and spring arrangement is used to help produce the desired oscillating action and the desired flow pulsing action.

BRIEF SUMMARY OF THE INVENTION

In one aspect of the invention, a downhole tool string component comprises a fluid passageway formed between a first and second end. A valve mechanism is disposed within the fluid passageway adapted to substantially cyclically build-up and release pressure within the fluid passageway such that a pressure build-up results in radial expansion of at least a portion of the fluid passageway and wherein a pressure release results in a contraction of the portion of the fluid passageway. The valve mechanism disposed within the fluid passageway comprises a spring. Expansion and contraction of the portion of the fluid passageway assisting in advancing the drill string within a subterranean environment. This advancing may be accomplished by varying a weight loaded to a drill bit, helping to propel the drill string along a horizontal well.

A spring is adapted to oppose the travel of a fluid flow. The spring is a tension spring or a compression spring. The spring is disposed intermediate a carrier and a centralizer and is aligned coaxially with the downhole tool string component. The valve mechanism comprises a shaft radially supported by a bearing and the centralizer. The carrier is mounted to the shaft. The centralizer is adapted to align the shaft coaxially with the downhole tool string component. The bearing is disposed intermediate the shaft and the centralizer. The carrier comprises at least one port. The carrier comprises a first channel formed on a peripheral edge substantially parallel with an axis of the tool string component.

The drilling fluid is adapted to push against a fluid engaging surface disposed on the carrier. The valve mechanism comprises an insert disposed intermediate and coaxially with the first end and the carrier. The centralizer and the insert are fixed within the fluid passageway. The insert comprises a taper adapted to concentrate the flow of the downhole tool string fluid into the carrier. The engagement of the fluid against the carrier resisted by the spring of the valve mechanism causes the first and second set of ports to align and misalign by oscillating the shaft. The insert further comprises a second channel on its peripheral edge. The valve mechanism comprises a fluid by-pass. The bit is adapted to cyclically apply pressure to the formation. The drill bit comprises a jack element with a distal end protruding from a front face of the drill bit and substantially coaxial with the axis of rotation of the bit.

DETAILED DESCRIPTION OF THE INVENTION AND THE PREFERRED EMBODIMENT

Figure 1:
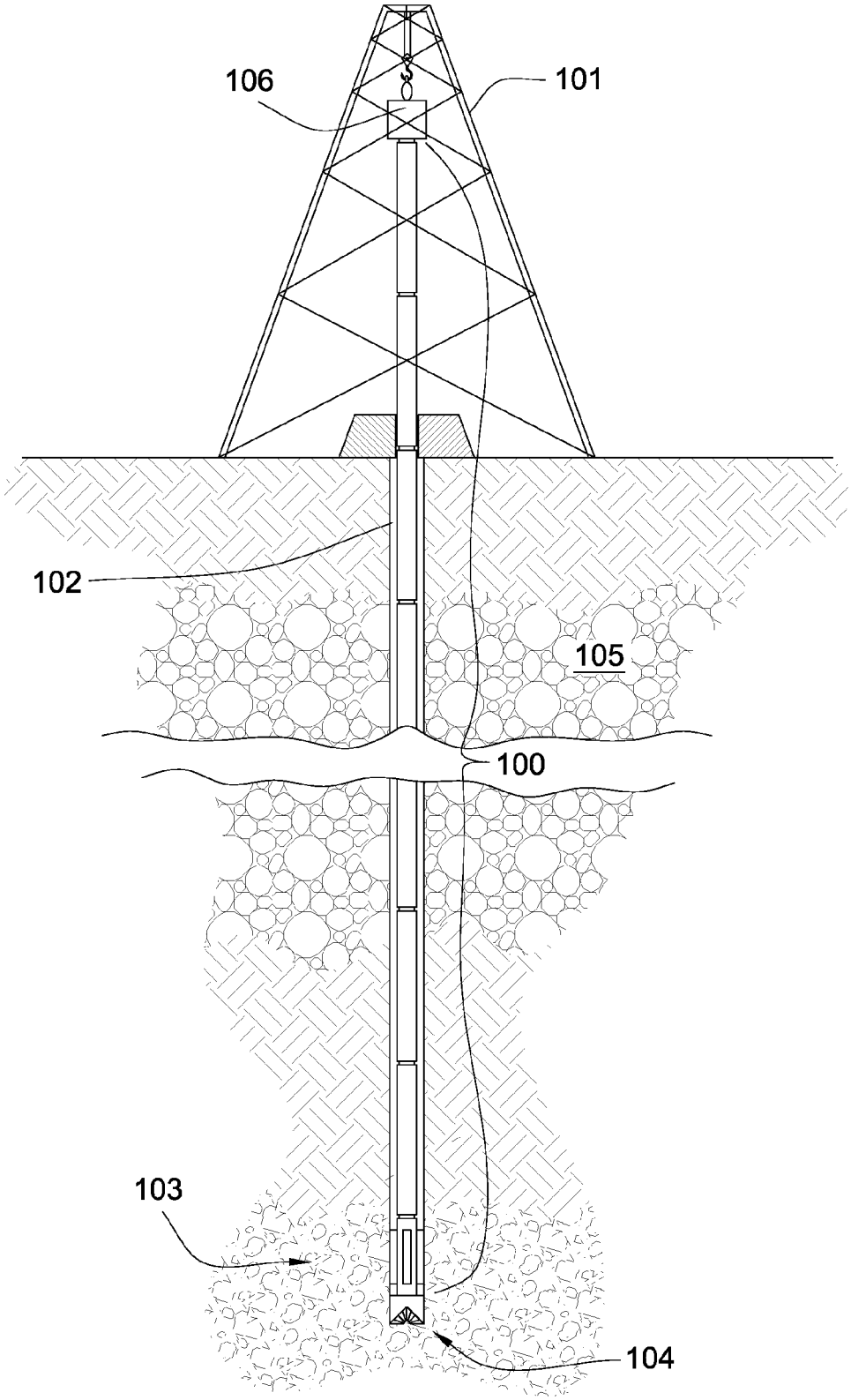
FIG. 1 is a perspective diagram of an embodiment of a string of downhole tools suspended in a borehole.

FIG. 1 is a perspective diagram of an embodiment of a string of downhole tools 100 suspended by a derrick 101 in a borehole 102. A bottom-hole assembly 103 may be located at the bottom of the borehole 102 and may comprise a drill bit 104. As the drill bit 104 rotates downhole the tool string 100 may advance farther into the earth. The drill string 100 may penetrate soft or hard subterranean formations 105. The bottom-hole assembly 103 and/or downhole components may comprise data acquisition devices which may gather data. The data may be sent to the surface via a transmission system to a data swivel 106. The data swivel 106 may send the data to the surface equipment. Further, the surface equipment may send data and/or power to downhole tools and/or the bottom-hole assembly 103. In some embodiments of the invention, no downhole telemetry system is used.

Figure 2:
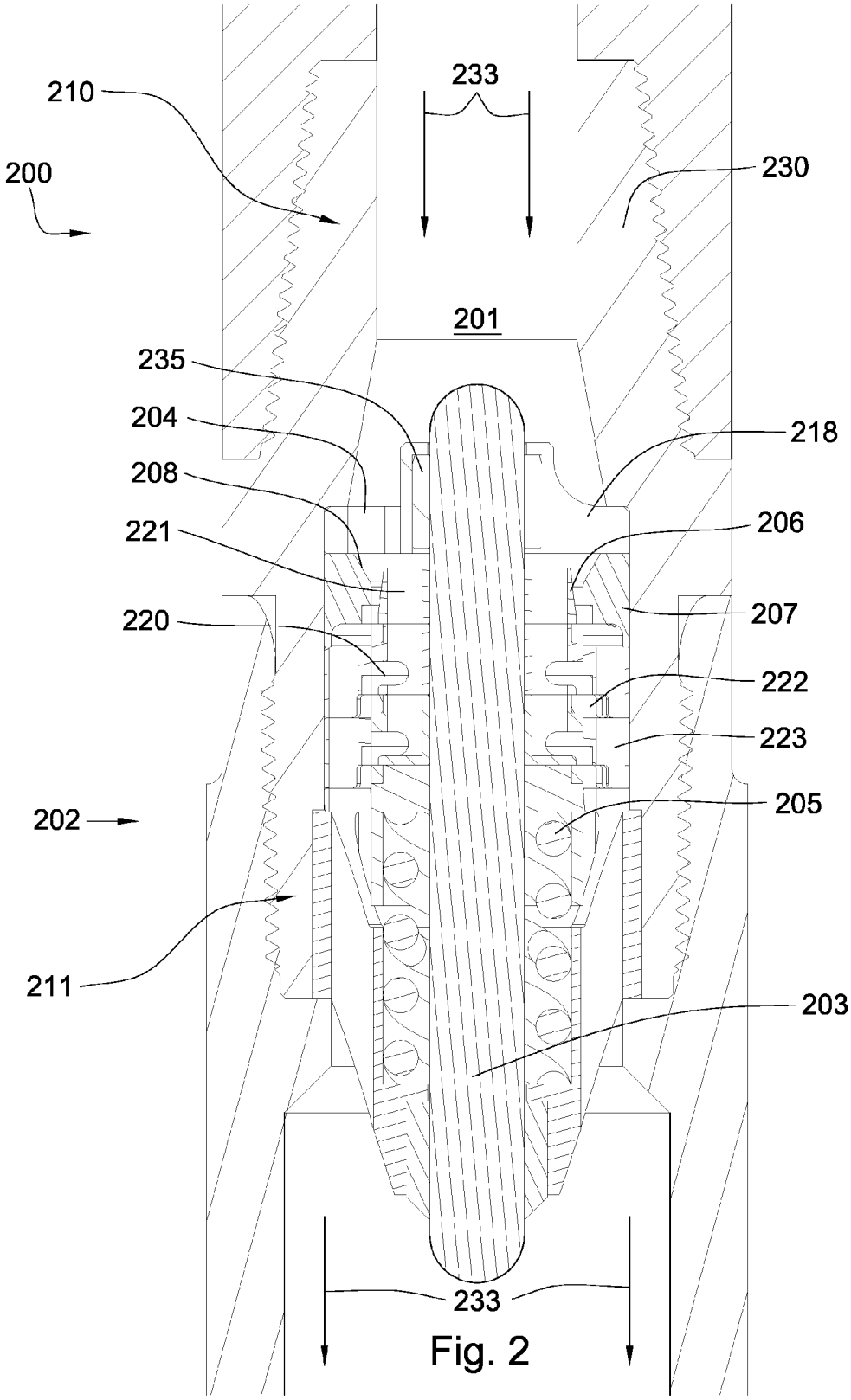
FIG. 2 is a cross-sectional diagram of an embodiment of a downhole tool string component.

FIG. 2 is a cross-sectional diagram of an embodiment of a downhole tool string component 200 comprised of a first end 210 and a second end 211. The fluid passageway 201 may comprise a valve mechanism 202. The valve mechanism 202 may comprise a shaft 203 aligned coaxially with the downhole tool string component 200 by a centralizer 218. The valve mechanism 202 may also comprise a fluid by-pass 204. The valve mechanism 202 may also comprise a spring 205 adapted to oppose the travel of a fluid flow. The drilling fluid may follow a path indicated by the arrows 233. The spring 205 may be aligned coaxially with the downhole tool string component 200 and may be a compression spring or a tension spring. The valve mechanism 202 may also comprise a carrier 206 comprised of carrier ports 220 and a first channel 221. The valve mechanism 202 may also comprise an insert 207 disposed coaxially with the axis of the downhole tool string component 200. The insert 207 may comprise a set of insert ports 222 and a second channel 223. The insert 207 may comprise a taper 208 adapted to concentrate the flow of the drilling fluid into the carrier 206. The spring 205 may be adapted to resist the engagement of the fluid flow against the carrier 206. Without the fluid flow the ports may be misaligned due to the force of the spring. Once flow is added, the misaligned ports may obstruct the flow causing a pressure build-up. As the pressure increases the force of the spring may be overcome and eventual align the ports. Once the ports are aligned, the flow may pass through the ports relieving the pressure build-up such that the spring moves the carrier to misalign the ports. This cycle of aligning and misaligning the carrier ports 220 and insert ports 222 aids in the advancing the drill string within its subterranean environments. As both sets of ports 220,222 are misaligned, the pressure build up from the drilling fluid may cause the wall 230 of the downhole drill string component 200 to expand. As both sets of ports 220, 222 are aligned, the pressure build up from the drilling fluid may be released as the drilling fluid is allowed to flow from the first channel 221, through the ports 220,222 and into the second channel 223. The shaft 203 and carrier 206 may be secured to each other by means of press-fitting the shaft 203 into the carrier 206 or shrink fitting the carrier 206 over the shaft 203. The shaft 203 may be allowed to move axially by a bearing 235 disposed intermediate the centralizer 218 and shaft 203.

Figure 3A:
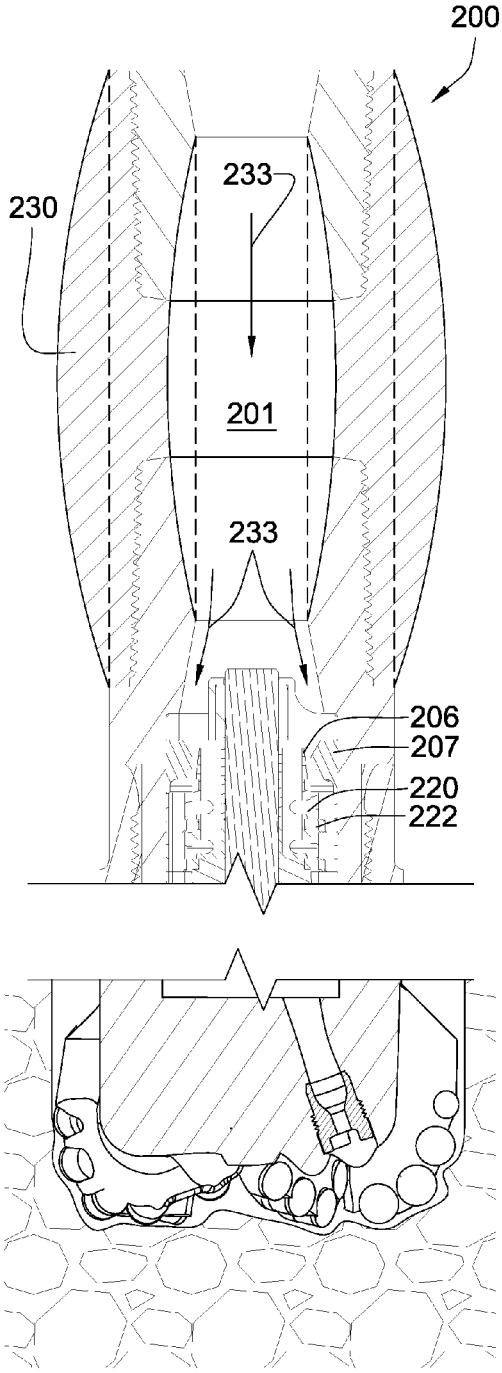
FIG. 3*a* is a cross-sectional diagram of another embodiment of a downhole tool string component.

FIG. 3*a* shows a cross-sectional diagram of another embodiment of a downhole tool string component 200. With the ports 220 on the carrier 206 misaligned in relation to the ports 222 on the insert 207, the drilling fluid is allowed to build up within the fluid passageway 201 causing the walls 230 of the downhole drill string component 200 to expand radially outward.

Figure 3B:
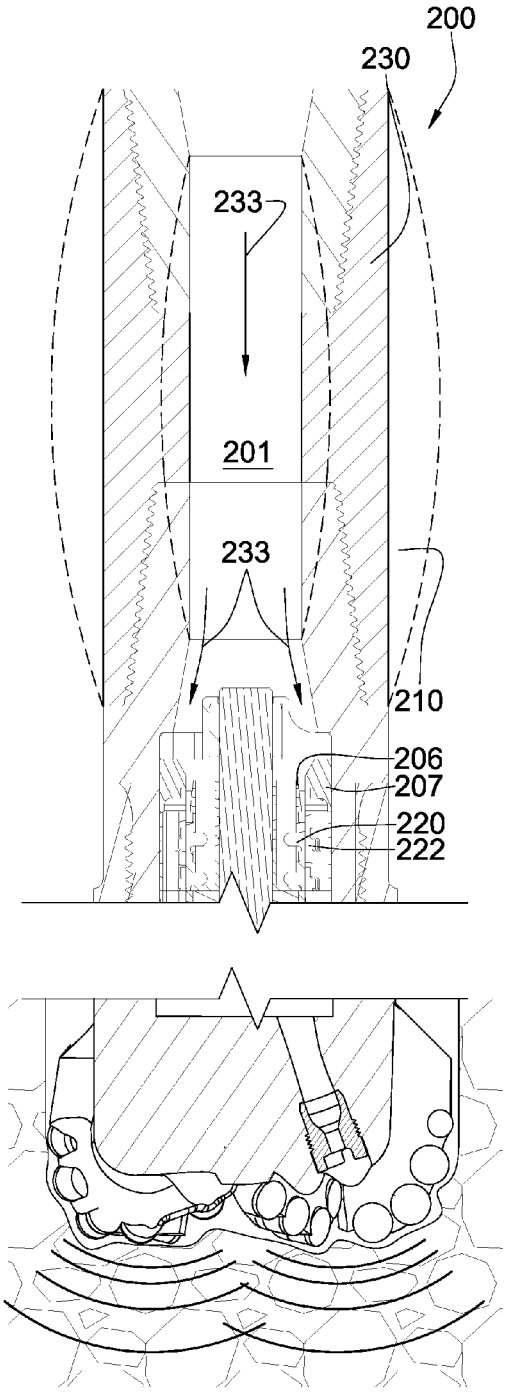
FIG. 3*b* is a cross-sectional diagram of another embodiment of a downhole tool string component.

FIG. 3*b* shows a cross-sectional diagram of another embodiment of a downhole tool string component 200. With the ports 220 on the carrier 206 aligned with the ports 222 on the insert 207, the drilling fluid is allowed to pass from the first end 210 to the second end 211 (shown in FIG. 2), thus releasing the build up of pressure within the fluid passageway 201 and allowing the walls 230 of the downhole drill string component 200 to contract. As the pipe radially contracts, the pipe is believed to expand axially. This axial expansion is believed to increase the weight loaded to the drill bit and transfer a pressure wave into the formation. In some embodiments, the pressure relief above the valve will increase the pressure below the valve thereby pushing against the drill bit, further increasing the weight loaded to the drill bit. Also in some embodiments the affect of the oscillating valve's mass will fluctuate the weight loaded to the drill bit.

Figure 4:
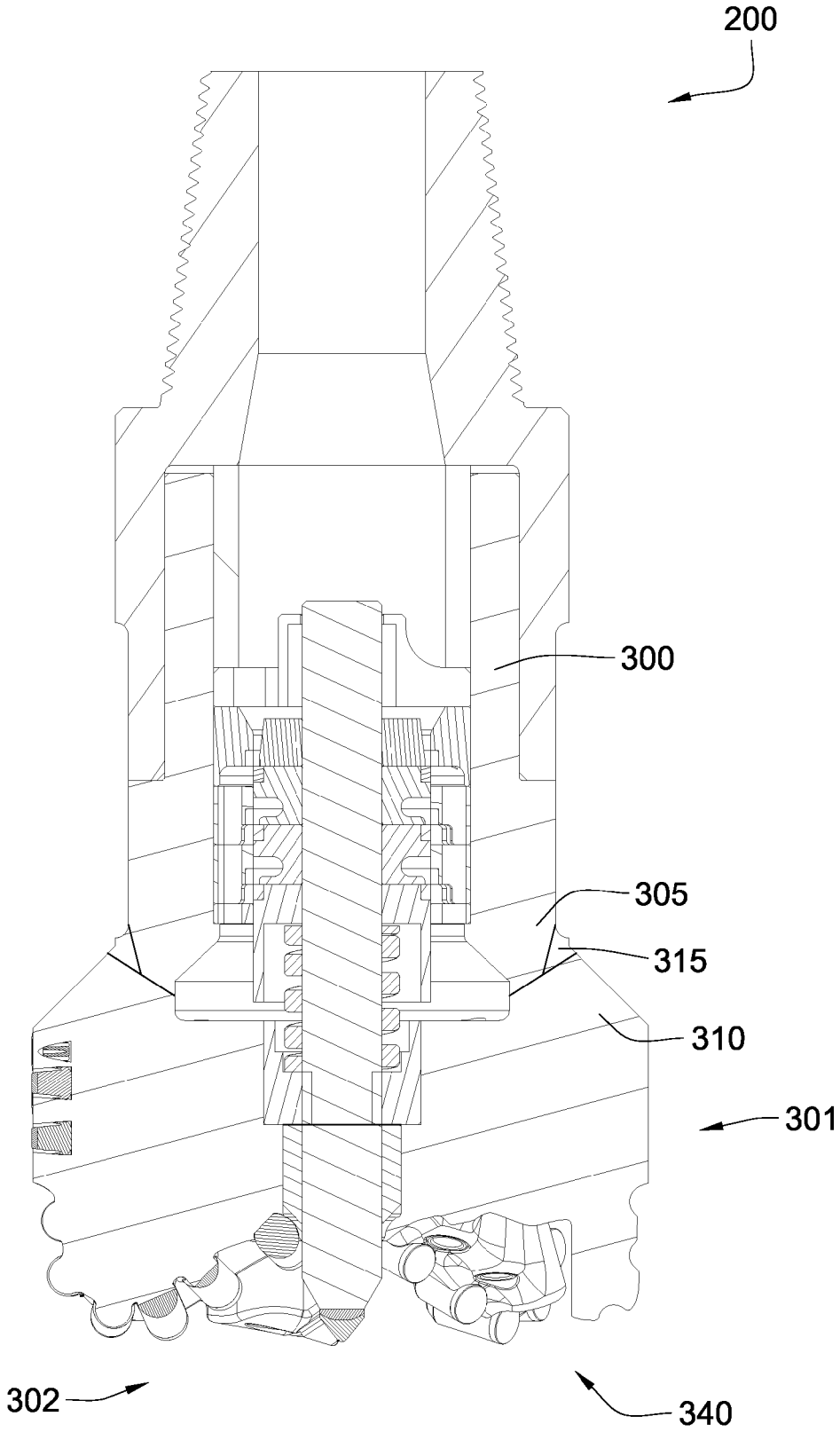
FIG. 4 is a cross-sectional diagram of an embodiment of a downhole tool string component with a drill bit.

FIG. 4 shows a cross-sectional diagram of a downhole drill string component 200 with a drill bit 340. The drill bit 340 may be made in two portions. The first portion 305 may comprise at least the shank 300 and a part of the bit body 301. The second portion 310 may comprise the working face 302 and at least another part of the bit body 301. The two portions 305, 310 may be welded together or otherwise joined together at a joint 315.

Figure 5:
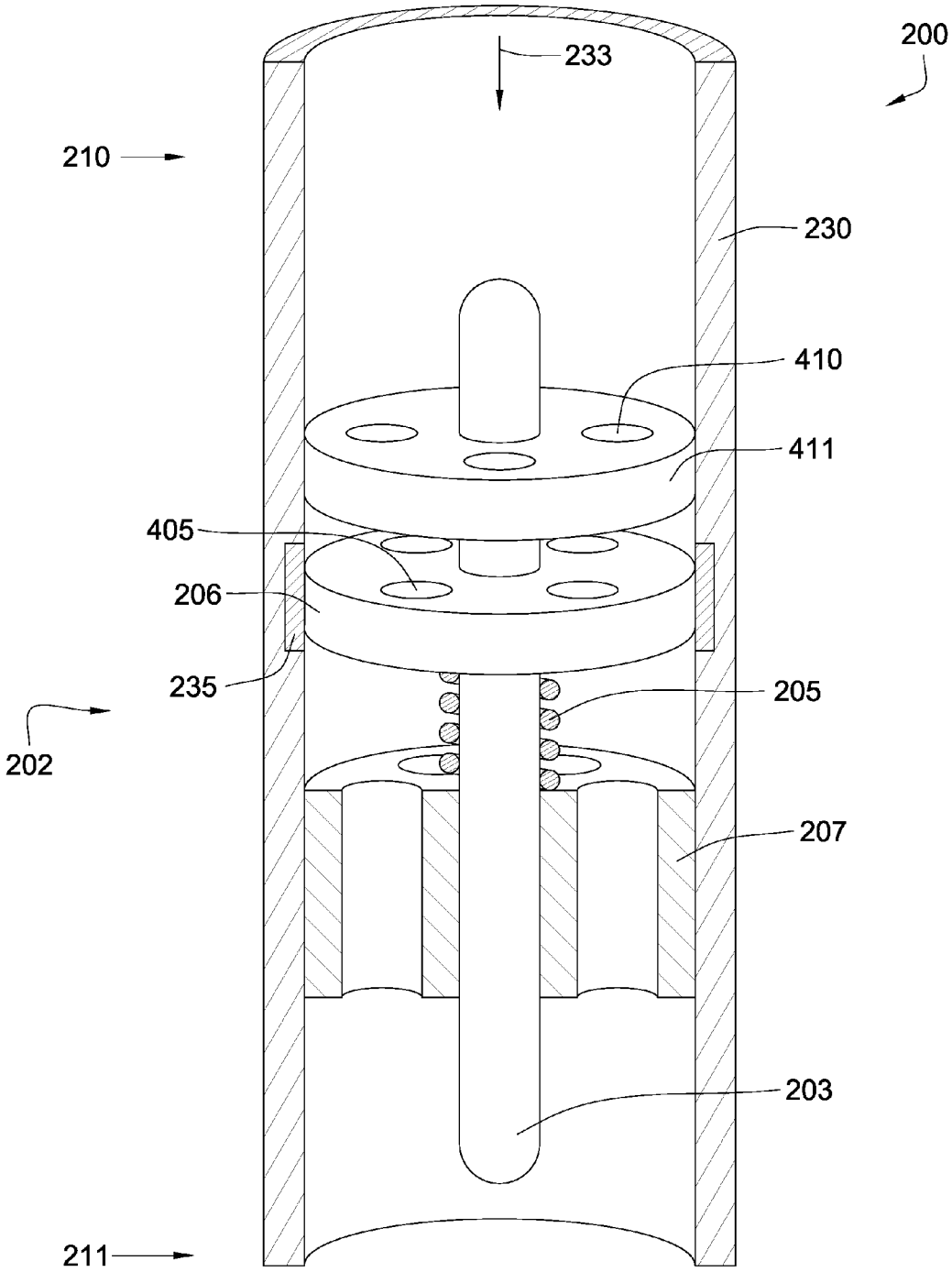
FIG. 5 is a cross-sectional diagram of another embodiment of a downhole tool string.

FIG. 5 shows a perspective diagram of another embodiment of a downhole tool string component 200. In this embodiment, the downhole tool string component 200 may comprise a valve mechanism 202. The valve mechanism 202 may comprise a carrier 206 which may be comprised of at least one hole 405 disposed on the carrier 206. The at least one hole 405 may be disposed offset at least one port 410 disposed on a guide 411 such that drilling fluid is unable to pass from the first end 210 to second end 211 if the carrier 206 is against the guide 411. The drilling fluid may follow the path indicated by the arrow 233. The guide 411 may be secured to the walls 230 of the downhole drill string component 200 and may serve to align the shaft 203 axially with the downhole drill string component 200. A bearing 235 may be disposed intermediate the carrier 206 and the wall 230 of the downhole drill string component 200. The valve mechanism 202 may also comprise an insert 207 disposed intermediate the wall 230 of the downhole drill string component 200 and the shaft 203. A spring 205 may be disposed intermediate the insert 207 and the carrier 206 and coaxially with the downhole drill string component 200.

Figure 6:
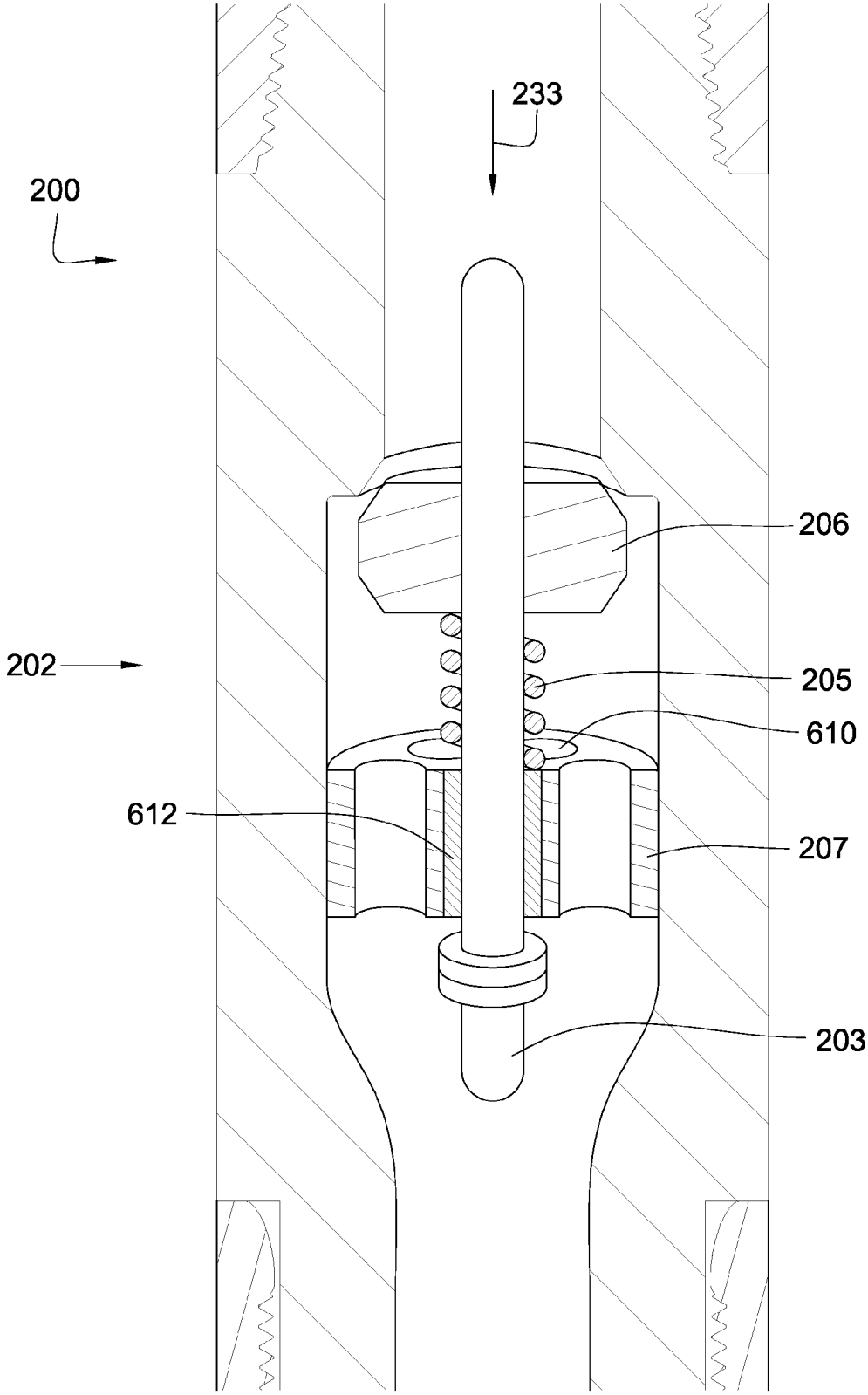
FIG. 6 is a cross-sectional diagram of another embodiment of a downhole tool string.

FIG. 6 shows a perspective diagram of another embodiment of a downhole tool string component 200. In this embodiment, the valve mechanism 202 may comprise a spring 205 disposed intermediate a carrier 206 and insert 207 and coaxially with the downhole tool string component 200. The insert 207 may comprise a set of ports 610 and a bearing 612 disposed intermediate a shaft 203 and the insert 207. The drilling fluid may follow the path indicated by the arrow 233.

Figure 7:
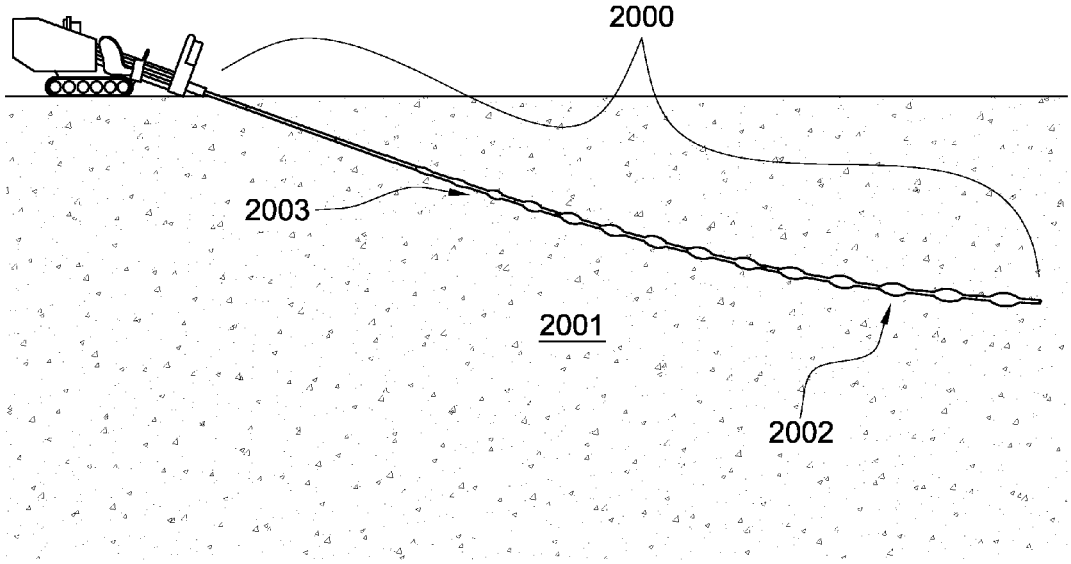
FIG. 7 is a perspective diagram of a tubular assembly.

FIG. 7 is a perspective diagram of a tubular assembly 2000 penetrating into a subterranean environment 2001. Preferable the tubular assembly 2000 is a drill string 100 (illustrated in FIG. 1) and comprises a bore for the passing drilling mud through. The tubular assembly may comprise a mechanism for contracting and expanding a diameter of the tubular assembly such that a wave is generated which travels along a length of the tubular assembly. This mechanism may be a valve mechanism such as the valve mechanism described in FIG. 2. In horizontal drilling applications the length 2003 of the tubular assembly may be engaged with the bore wall and waves 2002 may aid in moving the tubular assembly in its desired trajectory. In some embodiments of the present invention, the tubular assembly is not rotated such as in traditionally oil and gas exploration, but is propelling along its trajectory through the waves 2002.

The tubular assembly may be used in oil and gas drilling, geothermal operations, exploration, and horizontal drilling such as for utility lines, coal methane, natural gas, and shallow oil and gas.

In one aspect of the present invention a method for penetrating a subterranean environment includes the steps of providing a tubular assembly with a oscillating valve mechanism disposed within its bore, the valve mechanism comprising the characteristic such that as a fluid is passing through the valve, the valve will oscillate between an open and closed position; generating a wave along a length of the tubular assembly by radially expanding and contracting the tubular assembly by increasing and decreasing a fluid pressure by oscillating the valve mechanism; and engaging the length the tubular assembly such that the wave moves the tubular assembly along a trajectory.

In another aspect of the present invention a method for penetrating a subterranean environment comprises the steps of providing a tubular assembly with a mechanism disposed within its bore adapted to expand and contract a diameter of the tubular assembly; generating a wave along a length of the tubular assembly by radially expanding and contracting a diameter of the tubular assembly; and engaging the length the tubular assembly such that the wave moves the tubular assembly along a trajectory.

Whereas the present invention has been described in particular relation to the drawings attached hereto, it should be understood that other and further modifications apart from those shown or suggested herein, may be made within the scope and spirit of the present invention.

What is claimed is:

1. A downhole tool string component, comprising:

a fluid passageway being formed between a first and second end;

a valve mechanism disposed within the fluid passageway adapted to substantially cyclically build-up and release pressure within the fluid passageway such that a pressure build-up results in radial expansion of at least a portion of the fluid passageway and wherein a pressure release results in a contraction of the portion of the fluid passageway, wherein the valve mechanism disposed within the fluid passageway comprises a spring;

wherein the expansion and contraction of the portion of the fluid passageway assist in advancing the tool string component within a subterranean environment.

2. The component of claim 1, wherein the advancing the tool string component within a subterranean environment includes varying a weight loaded to a drill bit.

3. The component of claim 1, wherein the advancing the tool string component within a subterranean environment includes propelling the drill string along a horizontal well.

4. The component of claim 1, wherein the spring is adapted to oppose the travel of a fluid flow.

5. The component of claim 1, wherein the spring is a tension spring or a compression spring.

6. The component of claim 1, wherein the spring is disposed intermediate a carrier and a centralizer.

7. The component of claim 1, wherein the spring is aligned coaxially with the downhole tool string component.

8. The component of claim 1, wherein the valve mechanism comprises a shaft radially supported by a bearing and a centralizer.

9. The component of claim 8, wherein a carrier is mounted to the shaft.

10. The component of claim 9, wherein the centralizer is adapted to align the shaft coaxially with the downhole tool string component.

11. The component of claim 10, wherein the carrier comprises at least one port.

12. The component of claim 11, wherein the carrier comprises a first channel formed on a peripheral edge substantially parallel with an axis of the tool string component.

13. The component of claim 9, wherein drilling fluid is adapted to push against a fluid engaging surface disposed on the carrier.

14. The component of claim 9, wherein the valve mechanism comprises an insert disposed intermediate and coaxially with the first end and the carrier.

15. The component of claim 14, wherein the centralizer and the insert are fixed within the fluid passageway.

16. The component of claim 15, wherein the insert comprises a taper adapted to concentrate the flow of the downhole tool string fluid into the carrier.

17. The component of claim 15, wherein the engagement of the fluid against the carrier resisted by the spring of the valve mechanism causes a first and second set of ports to align and misalign by oscillating the shaft.

18. The component of claim 17, wherein the insert further comprises a second channel on its peripheral edge.

19. The component of claim 1, wherein the valve mechanism comprises a fluid by-pass.

20. The component of claim 1, wherein the downhole tool string component comprises a drill bit that comprises a jack element with a distal end protruding from a front face of the drill bit and substantially coaxial with the axis of rotation of the bit.

* * * * *